US007597636B2

(12) United States Patent
Vallon et al.

(10) Patent No.: US 7,597,636 B2
(45) Date of Patent: Oct. 6, 2009

(54) TABLE-TENNIS TABLE

(75) Inventors: Guillaume Vallon, Roubaix (FR); Johann Guerizec, Faches Thumesnil (FR)

(73) Assignee: Decathlon, Villeneuve d'Ascq. (FR)

( * ) Notice: Subject to any disclaimer, the term of this patent is extended or adjusted under 35 U.S.C. 154(b) by 437 days.

(21) Appl. No.: 11/706,359

(22) Filed: Feb. 15, 2007

(65) Prior Publication Data

US 2007/0202971 A1 Aug. 30, 2007

(30) Foreign Application Priority Data

Feb. 21, 2006 (FR) ..... 06 01515

(51) Int. Cl.
*A63B 67/04* (2006.01)

(52) U.S. Cl. ..... 473/496

(58) Field of Classification Search ..... 473/496; 108/99, 115, 117

See application file for complete search history.

(56) References Cited

U.S. PATENT DOCUMENTS 3,101,062 A * 8/1963 Kanzelberger ..... 108/37
3,777,674 A * 12/1973 Parsons ..... 108/175
3,830,495 A * 8/1974 Hill ..... 473/496
6,425,835 B1 7/2002 Kettler
2004/0216649 A1 11/2004 Kettler et al.
2005/0197215 A1 * 9/2005 Cornilleau ..... 473/496
2007/0202971 A1 * 8/2007 Vallon et al. ..... 473/496

FOREIGN PATENT DOCUMENTS

DE 102 10 855 A1 9/2003
EP 1 332 695 A 8/2003
FR 2 729 302 A 7/1996
JP 09140846 * 6/1997

* cited by examiner

*Primary Examiner*—Raleigh W. Chiu
(74) *Attorney, Agent, or Firm*—Kenyon & Kenyon LLP

(57) ABSTRACT

The invention concerns a table-tennis table that includes two playing surfaces and a support structure for these two playing surfaces, where this support structure includes a structure for folding the two playing surfaces between a playing position, in which the playing surfaces are horizontal and aligned, and a storage position in which they are vertical and adjacent to each other. On either side of the two playing surfaces, the support structure includes at least one vertical upright. For each vertical upright, the folding structure includes a guidance element which is designed to slide along the vertical upright, which is connected so as to pivot on at least one playing surface, and which is fitted with a locating system used to lock the said guidance element at either of two heights on the vertical upright, one corresponding to the playing position, and the other to the storage position, and an operating handle for the location system which is designed to unlock the guidance element for passage from one position to the other.

8 Claims, 2 Drawing Sheets

TABLE-TENNIS TABLE

Figure 1:
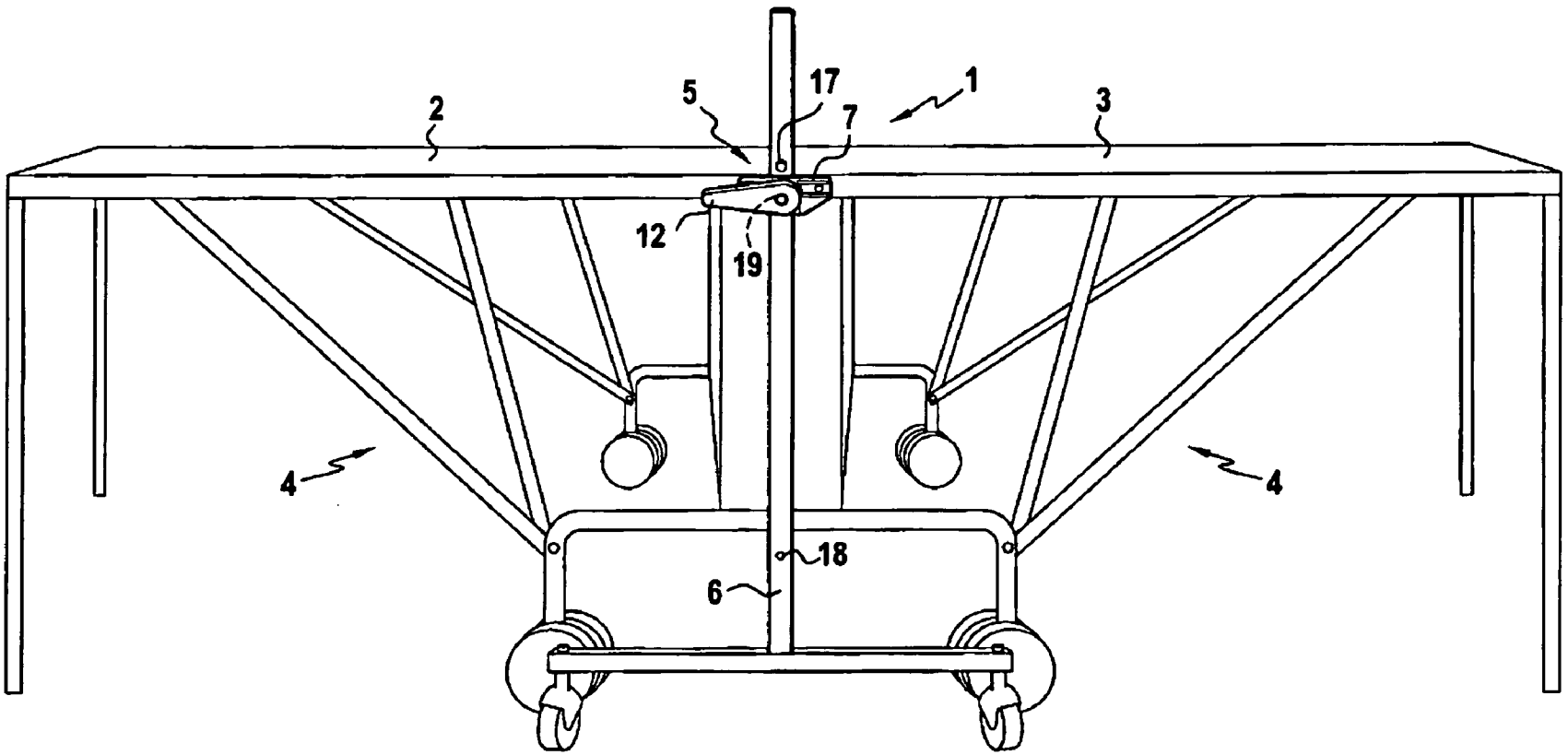

This application claims priority to French Patent Application No. 06/01515 filed 21 Feb. 2006.

This present invention concerns a table-tennis table, and more particularly a mobile table-tennis table, meaning one in which the playing surfaces can pass from a storage position, in which the playing surfaces are positioned more or less parallel to each other, to a playing position in which at least one of the two playing surfaces is lowered.

Generally, the mobile table-tennis tables can be moved from a storage location to a playing area, with movement of the table being achieved by pushing the table at the level of the playing surfaces, and causing it to roll into the playing area. Once positioned in the playing area, either one only of the playing surfaces is unfolded if one wishes to play using the raised surface as a "wall", or both playing surfaces are unfolded so that they are placed in the same horizontal plane. All of these operations necessitate a suitable system for locking/unlocking the playing surfaces, which will operate reliably in order to prevent any accidental unfolding of one or both playing surfaces while still allowing easy unlocking of the assembly.

In an advantageous manner, the locking/unlocking system of the table must also allow the correct positioning of the playing surfaces in relation to each other, whether in the folded or semi-folded position or in the playing position. It is important to note that in the playing position, positioning of the playing surfaces has to be effected with great precision, in order to place both of the playing surfaces exactly at the same level. Moreover, and again advantageously, the locking system may include an end-stop, in particular when a player impacts against the edge of a playing surface in the direction of the other, which may cause it to lift.

One is familiar with different devices that allow the passage and the locking of the playing surfaces of a table-tennis table, from a folded position to a playing position and vice versa.

However, the proposed devices have a variety of drawbacks, and in particular, do not allow the following characteristics to be achieved at the same time:

- simultaneous folding or unfolding of the two playing surfaces,
- correct registration of the playing and the raised positions,
- an actuating system that allows reliable and easy locking/unlocking of the position of the playing surfaces.

The aim of this present invention is to propose a table-tennis table whose structure in particular allows the achievement of the aforementioned characteristics at the same time.

In a manner that is already known, the table-tennis table includes two playing surfaces and a support structure for these two playing surfaces, where this support structure includes resources for converting the two playing surfaces between a playing position, in which the playing surfaces are horizontal and aligned, and a storage position in which they are vertical and adjacent to each other.

In a manner that is characteristic of this present invention, the support structure includes at least one vertical upright on either side of the playing surfaces, with the folding structure including a guidance element for each vertical upright. According to the invention, this guidance element is designed to slide along the vertical upright, and connected so as to pivot on at least one playing surface. Thus it is this part that will allow the positioning and the movement of the playing surfaces, by causing a translation motion that is the result of sliding along the vertical upright and the rotation of each playing surface on its pivoting axis. According to the invention, this guidance element is also fitted with a locating system that allows the locking of the guidance element at two heights on the vertical upright, one corresponding to the playing position and the other to the storage position. This particular arrangement can be used firstly to determine the playing and storage positions with precision, and secondly to effect control over the movement of the guidance element, and thereby over the playing surfaces of the table-tennis table.

According to the invention, the system also includes a handle for operation of the locating system, suitable for performing the unlocking of the guidance element to allow passage from one position to the other.

It is this guidance element that will enable easy operation of the assembly so that, in combination with the aforementioned characteristics, it allows the creation of a table-tennis table whose installation is easy and intuitive even for a novice user.

According to one implementation variant, the locating system includes a locating finger that is designed to be inserted into a locating hole placed at a specified height on the vertical upright, and rotation of the handle allows the withdrawal of the locating finger from the hole in the vertical upright. This arrangement firstly allows one to see the position of the locating finger, namely in the hole or in its retracted position, and also facilitates the movement of the locating finger in a simple manner, with the handle being accessible either when the table-tennis table is in the storage or playing position.

Advantageously, the locating finger is fixed to the handle on the pivoting axis of the latter, the handle being mounted on the guidance element by means of a device that causes a movement in translation of the locating finger when handle is rotated. This arrangement allows a compact handle/guidance assembly to be achieved, and a direct connection between the handle and the guidance element, both being made from the same material. In this implementation variant, the device thus allowing the movement in translation of the locating finger includes two tubular elements, one being an extension of the other, with the first belonging to the handle and the second to the guidance element, and the profiles of the adjacent edges of these two tubular elements constituting a cam profile designed to convert the angular motion of the handle into longitudinal motion of the locating finger. This arrangement allows the angular motion of the handle to be converted into longitudinal motion of the locating finger, and the depth of withdrawal of the locating finger can thus be adjusted precisely, following the geometry of the cam.

According to one advantageous variant of the invention, the table includes a stud against which the handle stops, designed to maintain the said handle in the unlocked position of the guidance element. This arrangement allows the automatic release of the finger.

According to one variant of the invention, on either side of the two playing surfaces the support structure includes only one vertical upright, each guidance element being connected so as to pivot on the two playing surfaces. This arrangement allows the number of parts necessary for the movement of the playing surfaces to be limited.

According to another method of implementation, on either side of the two playing surfaces the support structure includes two vertical uprights, where for each vertical upright the said table includes a guidance element which is connected so as to pivot on one playing surface only. This arrangement allows one, for example, to play with only one playing surface lowered, with the other playing surface acting as wall.

Figure 2:
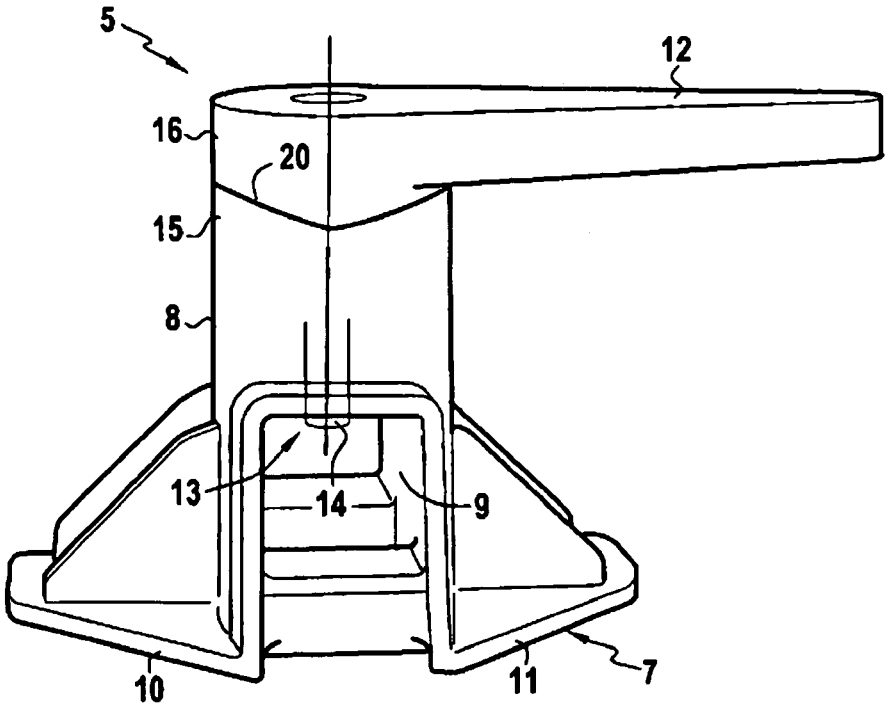
Figure 3:
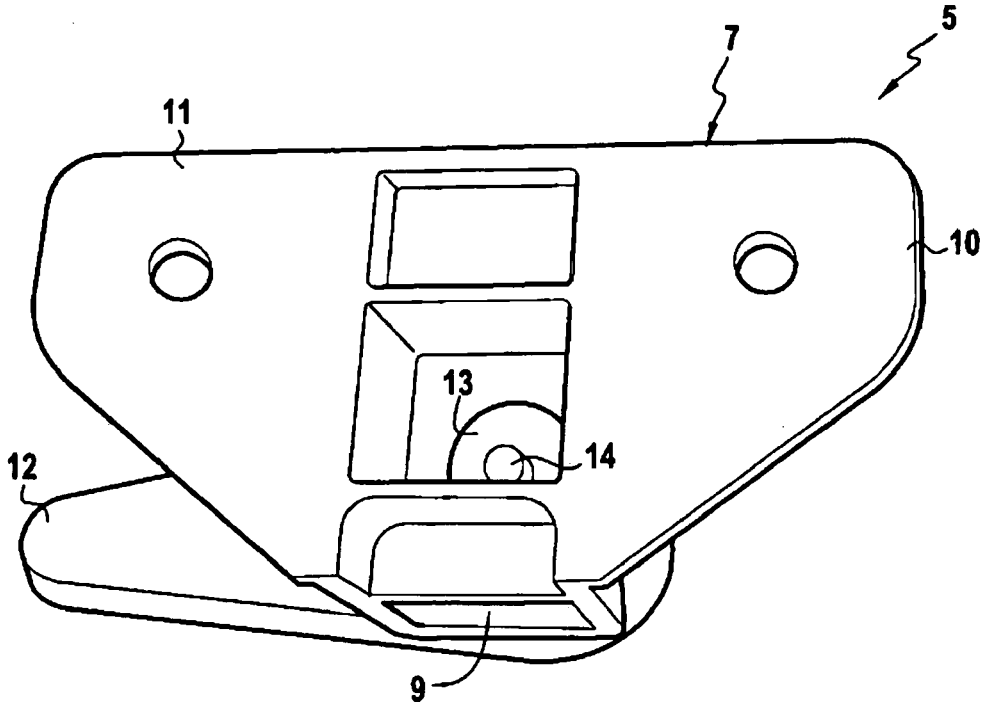

This present invention will be understood more clearly on reading the description that follows, of a preferred implementation example in which the description is given only by way of a non-limiting example, and with reference to the appended drawings in which:

FIG. 1 is a schematic representation, in perspective, of an example of implementation of a table-tennis table according to the invention, FIG. 2 also shows, in schematic view and in perspective, an element of the table-tennis table represented in FIG. 1 from a first angle, FIG. 3 represents the element of FIG. 2, viewed from a second angle.

Referring mainly to FIG. 1, we see partially represented a table-tennis table 1 with two playing surfaces 2 and 3 shown in this figure in the playing position, that is with the playing surfaces 2 and 3 lowered.

The said table 1 is also fitted with a support structure 4 with folding resources 5 that include different elements which are very familiar to the professional engineer, such as small and large struts, and legs fitted in pairs.

In the example of FIG. 1, the table-tennis table 1 is fitted with only a single vertical upright 6 on each side. This vertical upright 6 is designed to receive a guidance element 7, which is represented in detail in FIGS. 2 and 3.

This guidance element 7 includes a main body part 8 in which an opening 9 is created to allow the more or less regulated sliding of the said guidance element 7 along the vertical upright 6. The said guidance element 7 also includes securing plates 10 and 11 connected to pivot on the two playing surfaces 2, 3.

It is important to point out here that, in the version with four vertical uprights 6, each guidance element 7 is connected to only one playing surface 2 or 3, and therefore has only one securing plate 10, 11.

The guidance element 7 is operated by a handle so as to drive 12 a locating system 13. As shown in the advantageous method of implementation represented in FIGS. 1 to 3, the locating system 13 includes a locating finger 14 designed to be inserted into a locating hole 18 placed at different heights in the vertical upright 6.

One locating hole 18 is placed in the vertical upright 6 corresponding to the position of the guidance element 7 when the playing surfaces 2 and 3 are raised, and another 19 corresponds to the position of the playing surfaces 2 and 3 in the lowered position.

Rotation of the operating handle 12 leads to movement of the locating finger 14 to which it is connected, on the pivoting axis of the latter. Depending on the direction of rotation of the operating handle 12, the locating finger 14 moves so that it is located either in a hole or so that it is withdrawn from the latter.

Referring mainly to FIG. 2, we see the arrangement that effects the movement in translation of the locating finger 14.

This device takes the form of two tubular elements 15, 16, one being an extension of the other, where one of the tubular elements 15 belongs to the main body 8 and the other tubular element 16 belongs to the operating handle 12.

The profiles of the adjacent edges of these two tubular elements 15, 16 constitute a cam profile 20.This profile can advantageously be more or less V-shaped. This cam profile allows the conversion of an angular motion of the operating handle 12 into a longitudinal motion of the locating finger 14.

In order to facilitate the locking/unlocking of the locating system, the cam profile and the dimensioning of the locating finger 14 are designed so that an angular motion through an angle of the order of 60° is sufficient to move from a locked position to an unlocked position. It is also important to emphasise that a stud 17 can be provided against which the operating handle 12 comes to a stop, and that allows this handle 12 to be held in the locked position of the guidance element 7. This stud 17 will preferably be securely located at the level of the vertical upright 6. Stopping of the operating handle 12 is achieved by turning the latter 12 through an angle of 90°, and the handle 12 is released when the table is folded. Folding engenders a relative movement of the handle 12 in relation to the stud 17, so that the two elements 12, 17 are then no longer in contact, and the handle 12 returns to its initial, approximately vertical position. In practice, the operation to either store the table 1 or to place it in the playing position requires just a few quick movements. Thus to pass from the folded position to the playing position, the user turns the handle 12, which in turn extracts the locating finger 14 from the locating hole 18. The guidance element 7 is then released and can slide along the vertical upright 6.

When the user has lowered the playing surfaces 2, 3 so as to place it in the playing position, the guidance element 7 is positioned so that the locating finger 14 arrives opposite to the locating hole 19, and the user then only has to turn the handle 12 in order to insert the locating finger 14 into the said locating hole 19, after which the guidance element 7 is then locked and can no longer slide along the vertical upright 6. In order to pass from the playing position to the storage position, it suffices to perform the reverse operations to those described above, that is to unlock the guidance element 7 by turning the handle 12, raising the playing surfaces 2, 3 so that they are in a more or less vertical position, and then turning the handle 12 again so as to insert the locating finger 14 into the locating hole 18. As indicated previously, the detailed implementation example described above includes a vertical upright 6 on each side of the table-tennis table 1. In the version that uses two vertical uprights 6 on each side of the table-tennis table 1, only the connection between the guidance element 7 and the playing surfaces 2, 3 will be modified so that each of the four guidance parts 7 of the table-tennis table 1 are connected to pivot only on one playing surface (either 2 or 3).

Naturally, other methods of implementation that are within the scope of the professional engineer can also be envisaged, while still not moving outside the framework of the invention as determined by the following claims.

The invention claimed is:

1. A table-tennis table with two playing surfaces and a support structure for the two playing surfaces, where this support structure includes a structure for folding the two playing surfaces between a playing position, in which the playing surfaces are horizontal and aligned, and a storage position in which they are vertical and adjacent to each other, wherein, on either side of the two playing surfaces, the support structure includes at least one vertical upright, and in that for each vertical upright, the folding structures include a guidance element that is:

a) designed to slide along the vertical upright, b) connected so as to pivot on at least one playing surface, c) fitted with a locating system used to lock the said guidance element at two heights on the vertical upright, one corresponding to the playing position and the other to the storage position, d) equipped with an operating handle for the locating system, designed to unlock the guidance element to allow passage from one position to the other.

2. A table according to claim 1, wherein the locating system includes a locating finger, designed to penetrate into a locating hole placed at a specified height in the vertical upright, and wherein rotation of the handle allows the withdrawal of the locating finger from the hole in the vertical upright.

3. A table according to claim 2, wherein the locating finger is fixed to the handle, on the pivoting axis of the latter, and the handle is mounted on the guidance element by means of a device that performs a movement in translation of the locating finger when the handle is rotated.

4. A table according to claim 3, wherein the device thus allowing the movement in translation of the locating finger includes two tubular elements, one being an extension of the other, with the first belonging to the handle and the second to the guidance element, with the profiles of the adjacent edges of these two tubular elements constituting a cam profile designed to convert the angular motion of the handle into longitudinal motion of the locating finger.

5. A table according to claim 4 wherein the angular motion of the handle executes an angle of the order of 60 degrees.

6. A table according to claim 1, further comprising a stud against which the handle stops, designed to maintain the said handle in the locked position of the guidance element.

7. A table according to claim 1, wherein, on either side of the two playing surfaces, the support structure includes a single vertical upright, and each guidance element is connected so as to pivot on the two playing surfaces.

8. A table according to claim 1, wherein, on either side of the two playing surfaces, the support structure includes two vertical uprights, and for each vertical upright, the said table includes a guidance element which is connected so as to pivot on one playing surface only.

* * * * *